US008936174B1

(12) United States Patent
Kramer

(10) Patent No.: US 8,936,174 B1
(45) Date of Patent: Jan. 20, 2015

(54) PLASTIC BAG DISPENSER PIPE

(71) Applicant: Kurt R. Kramer, Saginaw, MI (US)

(72) Inventor: Kurt R. Kramer, Saginaw, MI (US)

( * ) Notice: Subject to any disclaimer, the term of this patent is extended or adjusted under 35 U.S.C. 154(b) by 84 days.

(21) Appl. No.: 13/796,929

(22) Filed: Mar. 12, 2013

(51) Int. Cl.

| | |
|---|---|
| ***A45F 5/10*** | (2006.01) |
| ***B65H 5/28*** | (2006.01) |
| ***B65D 25/20*** | (2006.01) |
| ***B65F 1/06*** | (2006.01) |
| *A47K 10/42* | (2006.01) |
| *B65D 83/08* | (2006.01) |
| *A47F 9/04* | (2006.01) |

(52) U.S. Cl.
CPC . *B65D 25/20* (2013.01); *B65F 1/06* (2013.01); *A47K 10/426* (2013.01); *B65D 83/0876* (2013.01); *A47K 10/421* (2013.01); *A47F 2009/041* (2013.01); *B65H 2701/191* (2013.01)
USPC ..... 221/45; 206/554; 248/309.1

(58) Field of Classification Search
CPC ..... A47K 10/421; A47K 10/426; A47F 2009/041; B65D 83/0876; B65F 1/06; B65H 2701/191
USPC ..... 248/95, 100, 309.1, 52, 68.1, 74.1, 905, 248/914, 311.2; 224/251; 206/466, 468, 206/554, 471, 494; 383/37, 104; 294/158, 294/171, 25; 221/45, 46, 47, 48; D9/434, D9/455
See application file for complete search history.

(56) References Cited

U.S. PATENT DOCUMENTS

| | | | | |
|---|---|---|---|---|
| 3,027,671 | A | 4/1962 | Duvall | |
| 3,826,361 | A * | 7/1974 | Heckrodt | 206/409 |
| 3,857,748 | A | 12/1974 | Thomann | |
| 4,657,800 | A | 4/1987 | Long | |
| 5,307,252 | A | 4/1994 | Croup et al. | |
| 5,333,821 | A * | 8/1994 | Lee | 248/52 |
| 5,409,745 | A | 4/1995 | McGuire | |
| 5,497,963 | A * | 3/1996 | Lee | 248/52 |
| 5,527,076 | A * | 6/1996 | Randels | 294/25 |
| D424,968 | S | 5/2000 | Vargo | |
| D435,479 | S | 12/2000 | Gansbuehler | |
| 6,305,572 | B1 * | 10/2001 | Daniels et al. | 221/48 |
| 6,814,486 | B2 * | 11/2004 | Sidoni | 374/208 |
| 7,090,272 | B2 * | 8/2006 | Novakovich et al. | 294/171 |
| D568,150 | S * | 5/2008 | Novakovich et al. | D9/434 |
| 7,601,407 | B2 | 10/2009 | Irvine | |

* cited by examiner

*Primary Examiner* — Tan Le

(57) ABSTRACT

The plastic bag dispenser pipe is constructed of a wall bracket from which a pipe member is rigidly affixed. The pipe member extends laterally an undefined length, and is further characterized with a front opening that spans along the length. The pipe member includes distal openings, which enable a plurality of individually folded plastic bags to extend at both distal openings. Each individually folded plastic bag is individually removed from the plastic bag dispenser pipe as needed. The wall bracket includes mounting surfaces that enable the plastic bag dispenser pipe to be secured to a generally planar surface.

1 Claim, 6 Drawing Sheets

PLASTIC BAG DISPENSER PIPE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of plastic bags, more specifically, a dispenser pipe that supports a plurality of unused plastic bags.

B. Discussion of the Prior Art

As will be discussed immediately below, no prior art discloses a wall bracket that includes a pipe member having a front opening spanning a length of said pipe member; wherein said pipe member is adapted for use in storing and supporting a plurality of unused plastic bags; wherein each plastic bag is able to be quickly removed from the pipe member via pulling through said front opening; wherein each plastic bag is individually folded to a thin profile, and inserted into the pipe member; wherein the pipe member includes distal openings that enable distal ends of the individually folded plastic bag to extend therefrom.

The Wilfong Patent Application Publication (U.S. Pub. No. 2008/0128465) discloses a recessed dispenser for plastic bags. However, the dispenser is designed for use with a roll of plastic bags and not individually folded plastic bags that are readily accessible from a pipe member that extends from a bracket.

The Jenkins patent (U.S. Pat. No. 7,338,008) discloses a roll trash bag dispenser. Again, the dispenser is adapted for use with a roll of plastic bags, and not individually folded plastic bags that are individually retrieved.

The LeCaire, Jr. et al. patent (U.S. Pat. No. Des. 254,585) illustrates a wall mounted plastic bag dispenser, which does not resemble a pipe member.

The Mygind patent (U.S. Pat. No. Des. 325,311) illustrates an ornamental design for a plastic roll dispenser, which does not resemble a pipe member.

The Orlando patent (U.S. Pat. No. 462,860) illustrates an ornamental design for a plastic bag dispenser, which does not resemble a pipe member.

The Neiberger et al. patent (U.S. Pat. No. Des. 452,788) illustrates an ornamental design for a plastic film dispenser, which does not resemble a pipe member.

The Barnett patent (U.S. Pat. No. 3,718,251) discloses a combined package and dispenser for a roll of plastic bags. Again, the dispenser is adapted for use in dispensing a roll of plastic bags, and not plastic bags that are individually folded and retrieved individually as well as independent of one another.

The LeCaire, Jr. et al. patent (U.S. Pat. No. 4,191,307) discloses a wall mounted dispenser for plastic bags. Again, the wall mounted dispenser is not a pipe member that includes a front opening through which individually folded plastic bags are retrieved.

The McKinley patent (U.S. Pat. No. 5,042,687) discloses a dispenser for shopping bags. However, the dispenser does not feature a pipe member with open distal ends and front opening through which a folded unused plastic bag is retrieved as needed.

The Simhaee patent (U.S. Pat. No. 6,279,806) discloses a dispenser for retaining and dispensing plastic bags. Again, the dispenser is directed to dispensing a roll of plastic bags and not individually folded unused plastic bags.

While the above-described devices fulfill their respective and particular objects and requirements, they do not describe a wall bracket that includes a pipe member having a front opening spanning a length of said pipe member; wherein said pipe member is adapted for use in storing and supporting a plurality of unused plastic bags; wherein each plastic bag is able to be quickly removed from the pipe member via pulling through said front opening; wherein each plastic bag is individually folded to a thin profile, and inserted into the pipe member; wherein the pipe member includes distal openings that enable distal ends of the individually folded plastic bag to extend therefrom. In this regard, the plastic bag dispenser pipe departs from the conventional concepts and designs of the prior art.

SUMMARY OF THE INVENTION

The plastic bag dispenser pipe is constructed of a wall bracket from which a pipe member is rigidly affixed. The pipe member extends laterally an undefined length, and is further characterized with a front opening that spans along the length. The pipe member includes distal openings, which enable a plurality of individually folded plastic bags to extend at both distal openings. Each individually folded plastic bag is individually removed from the plastic bag dispenser pipe as needed. The wall bracket includes mounting surfaces that enable the plastic bag dispenser pipe to be secured to a generally planar surface.

It is an object of the invention to provide a plastic bag dispenser pipe that enables individually folded plastic bags to be stored and selectively removed independently of one another.

A further object of the invention is to provide a pipe member that is laterally oriented and includes a front opening that spans a length of the pipe member, and through which individual plastic bags are selected and removed as needed.

An even further object of the invention is to provide a front opening that has a curvature.

An even further object of the invention is to have a front opening with a relatively thin width, which prevents the plastic bags from unintentionally becoming disengaged from the pipe member.

A further object of the invention is to provide a pipe member with distal openings at each end, which enable the individually folded plastic bags to be able to extend freely therefrom.

These together with additional objects, features and advantages of the plastic bag dispenser pipe will be readily apparent to those of ordinary skill in the art upon reading the following detailed description of presently preferred, but nonetheless illustrative, embodiments of the plastic bag dispenser pipe when taken in conjunction with the accompanying drawings.

In this respect, before explaining the current embodiments of the plastic bag dispenser pipe in detail, it is to be understood that the plastic bag dispenser pipe is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the plastic bag dispenser pipe.

It is therefore important that the claims be regarded as including such equivalent construction insofar as they do not depart from the spirit and scope of the plastic bag dispenser pipe. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
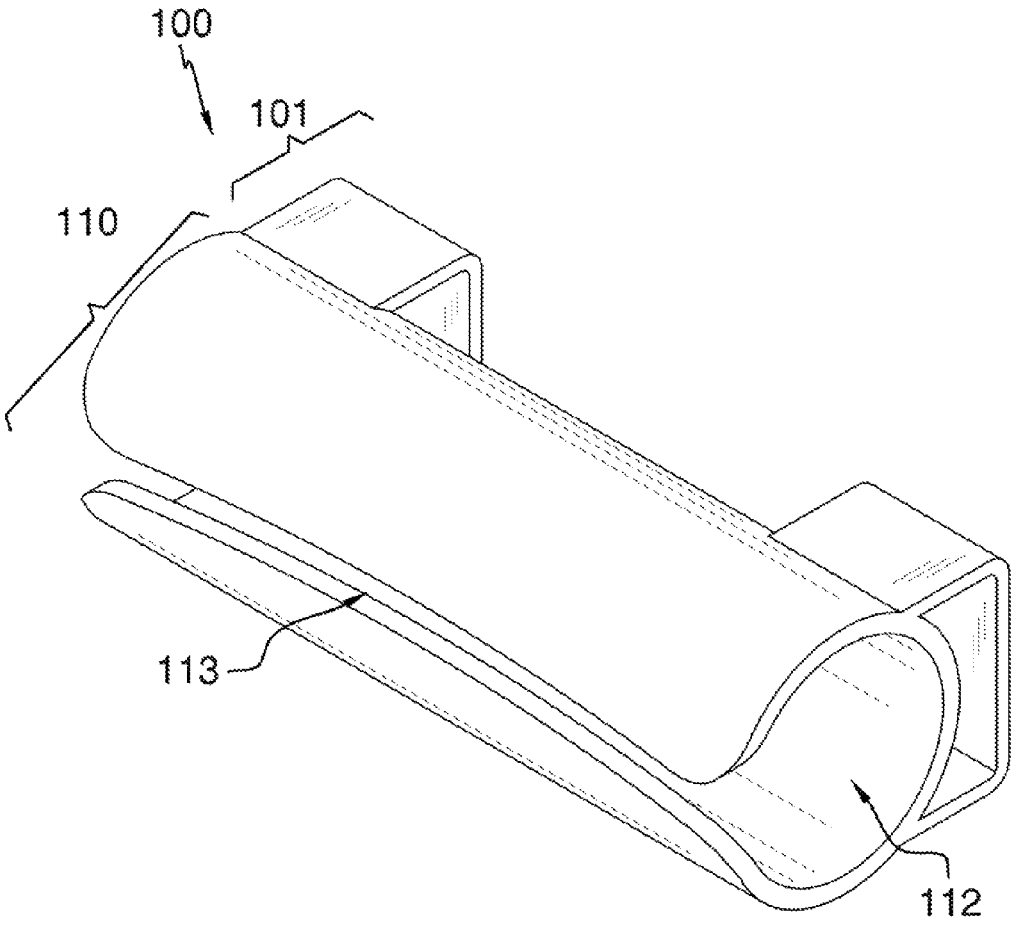
FIG. 1 illustrates a perspective view of the plastic bag dispenser pipe by itself.
Figure 3:
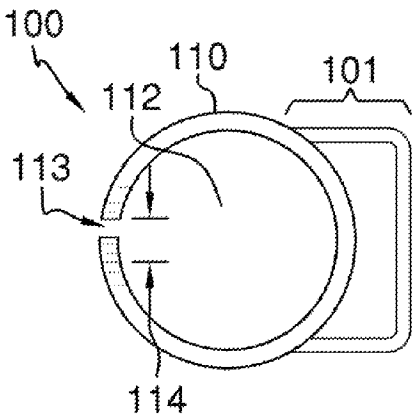
FIG. 3 illustrates a side end view of the plastic bag dispenser pipe, which details the hollowed construction of the pipe member.
Figure 2:
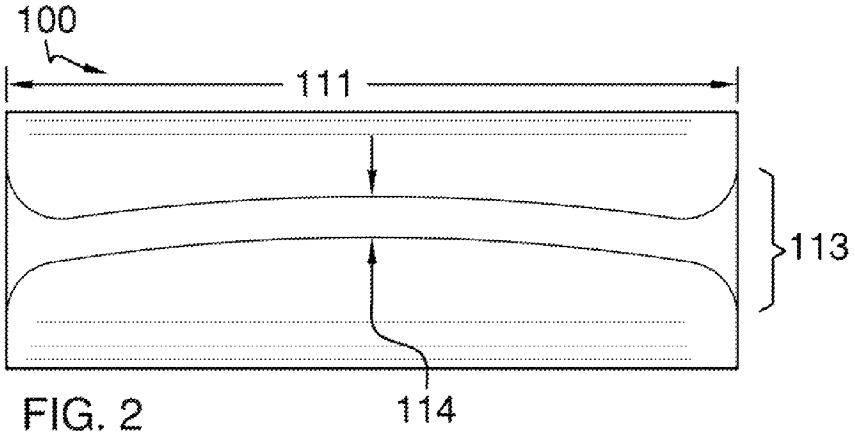
FIG. 2 illustrates a front view of the plastic bag dispenser pipe wherein the curvature of the front opening is more visible.
Figure 4:
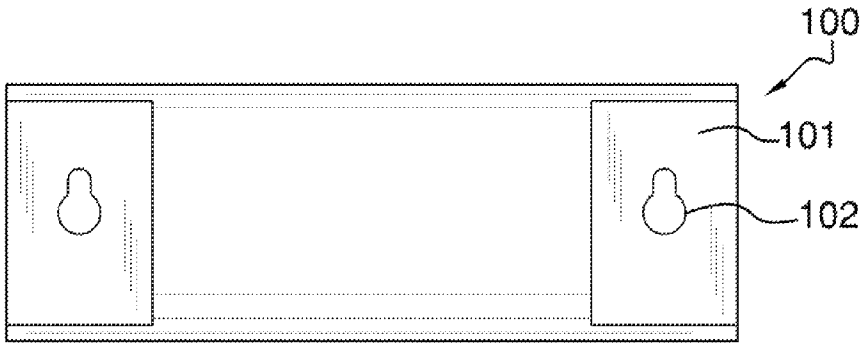
FIG. 4 illustrates a rear view of the plastic bag dispenser pipe, which details the wall bracket.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-10. A plastic bag dispenser pipe 100 (hereinafter invention) includes at least one wall bracket 101 that includes a mounting surface 102 thereon. The wall bracket 101 enables the invention 100 to be rigidly secured to a planar surface 200 via a securing member 201 in the form of a bolt, screw, nail, rivet, etc.

The wall bracket 101 is rigidly affixed to a pipe member 110, which is laterally or horizontally oriented. The pipe member 110 is of hollowed construction, and of an undefined length 111. The pipe member 110 is further defined with distal openings 112 and a front opening 113. The front opening 113 spans the length 111 of the pipe member 110. The front opening 113 has a curvature, which is more visibly depicted in FIG. 2. The front opening 113 has a front opening width 114, which is relatively thin in proportion to the length 111 of the pipe member 110. More specifically, the front opening width 114 shall be in at least a 1:10 ratio with respect to the length 111.

Figure 5:
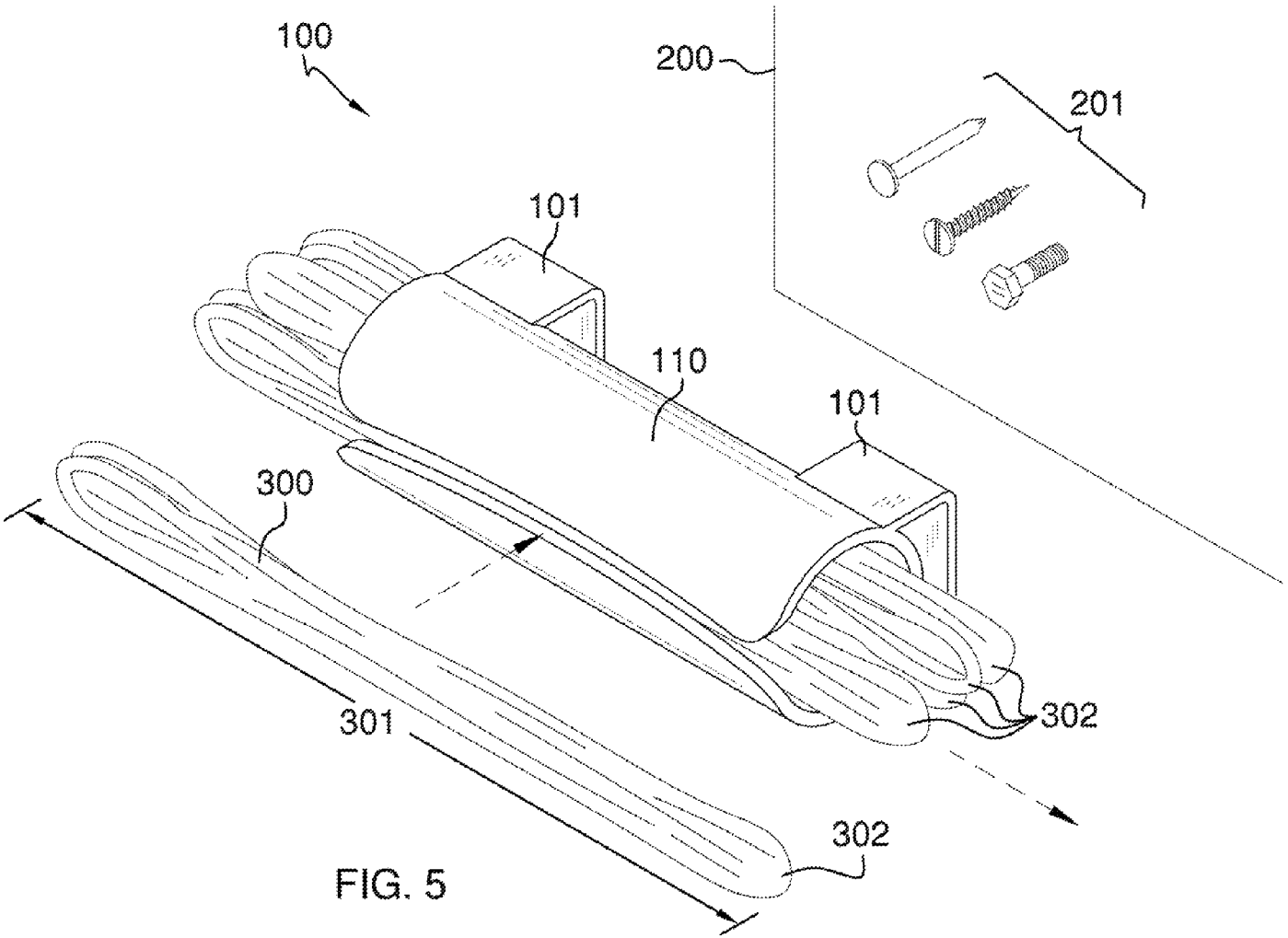
FIG. 5 illustrates a front, perspective view of the plastic bag dispenser pipe in use with several individually folded plastic bags being stored within the pipe member, and depicting one plastic bag being introduced through the front opening.
Figure 6:
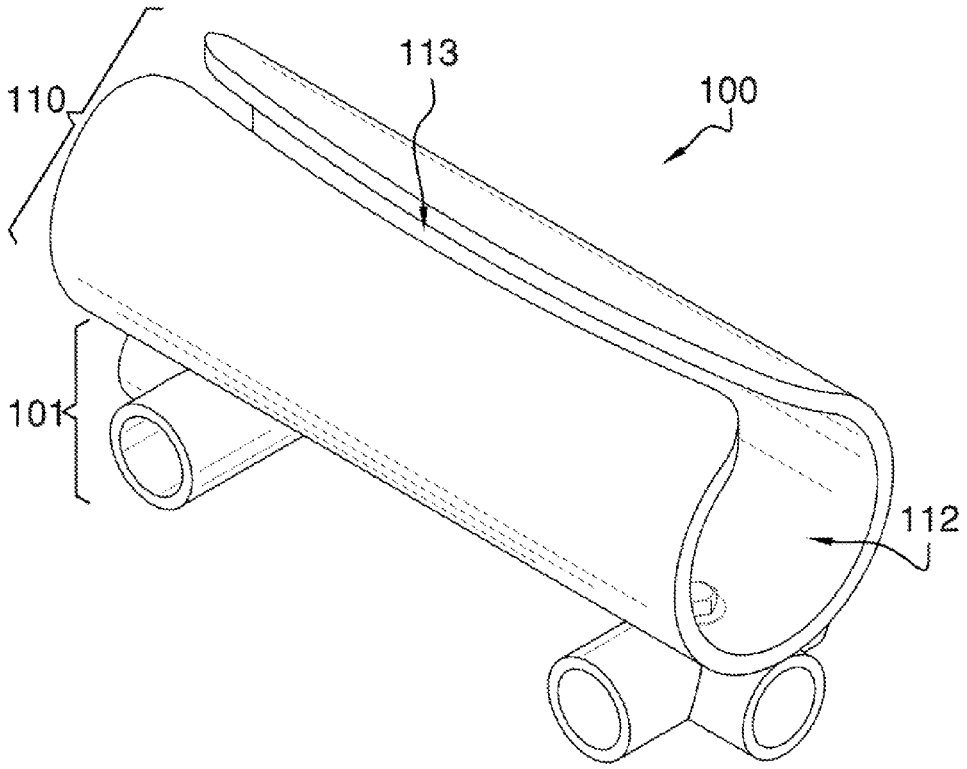
FIG. 6 illustrates a view of an alternative embodiment wherein a set of wall brackets that can act as feet.
Figure 8:
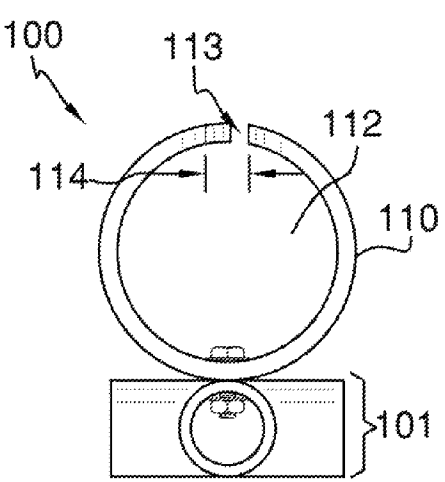
FIG. 8 illustrates an end view of the alternative embodiment.
Figure 7:
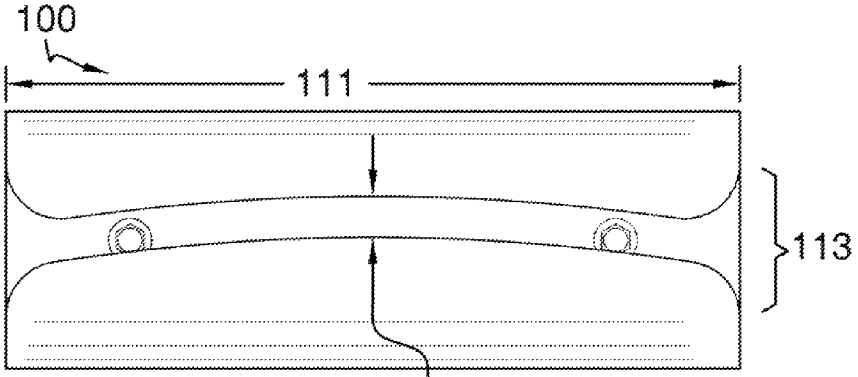
FIG. 7 illustrates a top view of the alternative embodiment.
Figure 9:
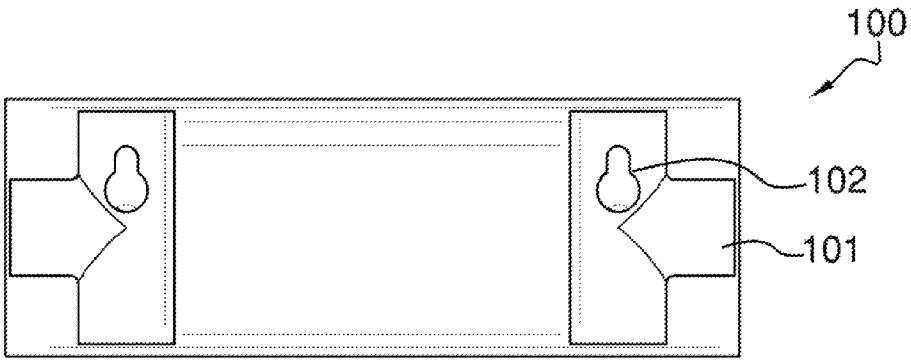
FIG. 9 illustrates a bottom view of the alternative embodiment.
Figure 10:
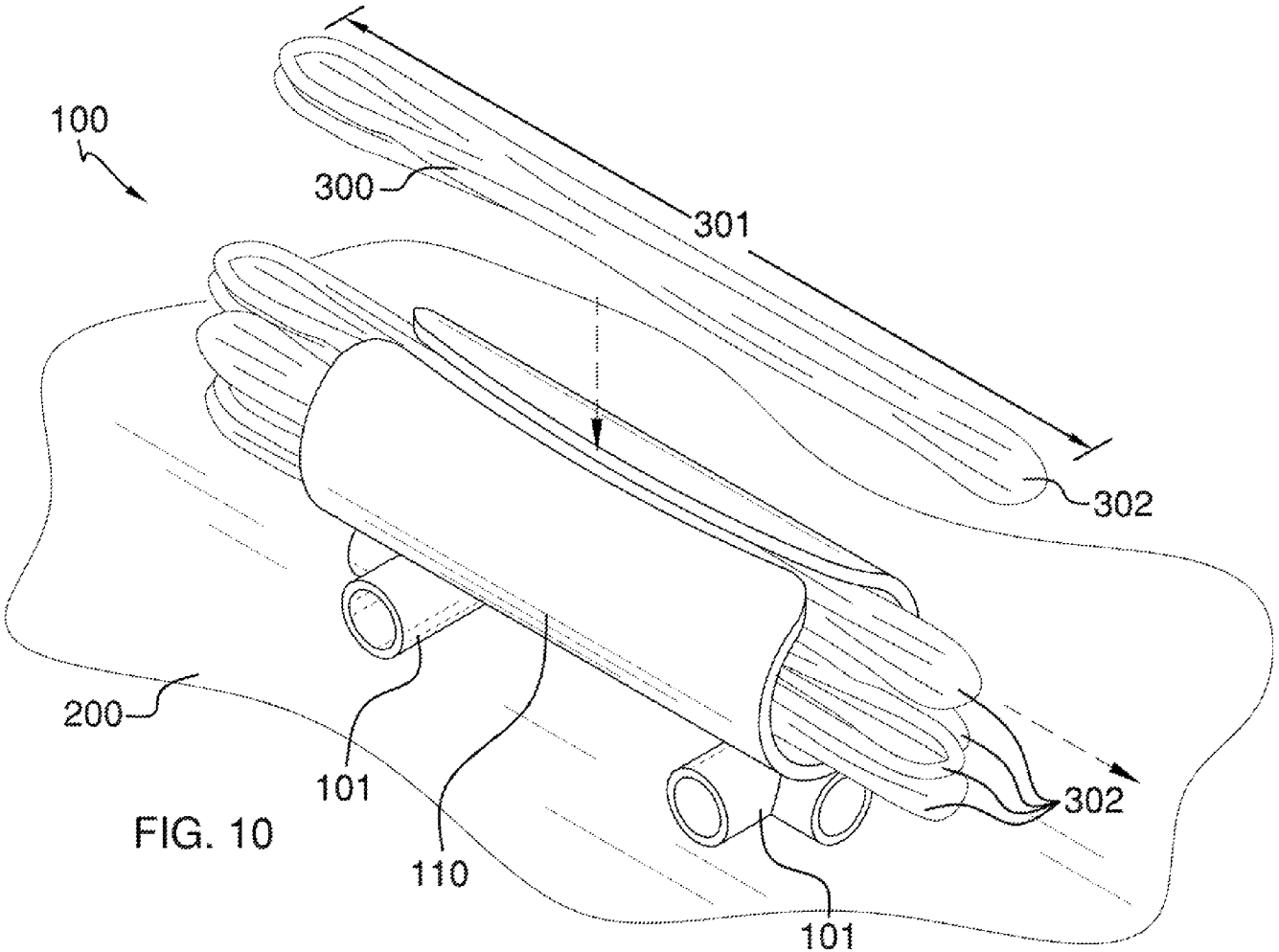
FIG. 10 illustrates a perspective view of the alternative embodiment in use.

Referring to FIG. 5, the invention 100 is used in order to support a plurality of plastic bags 300 within the pipe member 110. Moreover, the plastic bags 300 shall be individually folded, and have a bag length 301 greater than the length 111 of the pipe member 110 such that distal bag ends 302 of the plastic bags 300 lay exposed and outside of the invention 100. The plastic bags 300 are inserted into the pipe member 110 via the front opening 113. Moreover, each plastic bag 300 is retrieved from the invention 100 by either pulling on one of the two distal bag ends 302.

It shall be noted that the plastic bags 300 may be removed from or inserted into the pipe member 110 via the front opening 113. Moreover, the plastic bags 300 may be removed from or inserted into the pipe member 110 via the distal openings 112.

Referring to FIGS. 6-10, an alternative embodiment of the invention 100 utilizes a different type of wall bracket 101. Moreover, the wall bracket 101 can double as feet in order to support the invention 100 on a table or ground surface 200. Moreover, the wall brackets 101 have a mounting surface 102, which enables the securing members 201 to be used in order to support the invention 100 on the planar surface 200.

The wall brackets 101 may be characterized as feet and resemble a tri-pronged appendage that supports the invention 100 on the table or ground surface 200, but also includes the mounting surface 102 such that the invention 100 can be supported on the planar surface 200 as mentioned earlier.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A plastic bag dispenser pipe comprising:

a plurality of feet rigidly affixed to a pipe member that is configured to support and store a plurality of unused plastic bags;

wherein the pipe member includes distal openings and a front opening that spans a length of said pipe member;

wherein individually folded plastic bags are inserted into the pipe member and removed as needed;

wherein the feet enable the plastic bag dispenser pipe to be placed atop of a table or ground surface;

wherein the feet include a mounting surface in order to rigidly secure the feet and pipe member to a planar surface via a securing member in the form of a bolt, screw, nail, rivet;

wherein the pipe member is laterally or horizontally oriented with respect to the planar surface;

wherein the pipe member is of hollowed construction, and of an undefined length;

wherein the front opening spans the length of the pipe member, and has a curvature expressed along the length;

wherein the front opening has a front opening width, which is at least in a 1:10 ratio with respect to the length;

wherein the pipe member supports a plurality of plastic bags within the pipe member; wherein the plastic bags have a bag length greater than the length of the pipe member such that distal bag ends of the plastic bags lay exposed and outside of the pipe member at distal openings;

wherein the feet are further defined as tri-pronged appendages that supports the plastic bag dispenser pipe on the table or ground surface.

* * * * *